US005867135A

United States Patent [19]

Salavin et al.

[11] Patent Number: 5,867,135

[45] Date of Patent: Feb. 2, 1999

[54] METHOD FOR THE CONTROL OF A DISPLAY SCREEN AND DISPLAY DEVICE IMPLEMENTING THIS METHOD

[75] Inventors: Serge Salavin, Saint Egreve; Jacky Dutin, Saint Jean De Moirans, both of France

[73] Assignee: Thomson Tubes Electroniques, Meudon La Foret, France

[21] Appl. No.: 749,505

[22] Filed: Nov. 15, 1996

[30] Foreign Application Priority Data

Nov. 17, 1995 [FR] France ..... 95 13663

[51] Int. Cl.[6] ..... G09G 3/28

[52] U.S. Cl. ..... 345/68; 345/60

[58] Field of Search ..... 345/68, 112, 60

[56] References Cited

U.S. PATENT DOCUMENTS

| | | | |
|---|---|---|---|
| 4,650,434 | 3/1987 | Deschamps et al. | 445/2 |
| 5,030,888 | 7/1991 | Salavin et al. | 315/169.4 |
| 5,066,890 | 11/1991 | Salavin et al. | 313/585 |
| 5,075,597 | 12/1991 | Salavin et al. | 345/60 |
| 5,086,257 | 2/1992 | Gay et al. | 345/68 |
| 5,237,315 | 8/1993 | Gay et al. | 345/112 |

FOREIGN PATENT DOCUMENTS

| | | |
|---|---|---|
| 0032196 A3 | 7/1981 | France . |
| 0457637 A1 | 11/1991 | France . |

*Primary Examiner*—Amare Mengistu
*Assistant Examiner*—Ricardo Osorio
*Attorney, Agent, or Firm*—Oblon, Spivak, McClelland, Maier & Neustadt, P.C.

[57] ABSTRACT

An apparatus and a method for the control of a display screen, especially a plasma panel screen. The screen has cells that can be either in an erased state or in a "recorded" state in which they can be activated by alternating signals called sustaining signals. According to one characteristic, the method consists in dividing the cells into at least two groups, such as an upper group and a lower group, these two groups receiving sustaining signals alternately, and in applying to the cells, during the time when they do not receive the sustaining signals, memory signal enabling them to preserve their "recorded" state or their "erased" state. This results in a reduction of the pulsed discharge current.

12 Claims, 5 Drawing Sheets

METHOD FOR THE CONTROL OF A DISPLAY SCREEN AND DISPLAY DEVICE IMPLEMENTING THIS METHOD

BACKGROUND OF THE INVENTION

1. Field of the Invention

The invention relates to a method and apparatus for the control of an image display screen of the "memory effect" type. It is aimed in particular at reducing a so-called "pulsed discharge current" in order to reduce or even eliminate its harmful effects. The invention relates especially (but not exclusively) to screens whose picture elements are cells having two stable states, namely the "lit" state and the "extinguished" state.

The term "memory effect" is understood to mean the effect that enables cells to preserve the "lit" or "extinguished" state when the signal that has produced this state has already disappeared.

2. Discussion of the Background

Taking for example the case of an alternating plasma panel (PP) with two crossed electrodes to define a cell, this type of screen has cells with two stable states and benefits from a "memory effect" as described especially in the patent FR 2 417 848. A PP of this kind is described here below with reference to FIG. 1.

The PP has an array of electrodes Y1 to Y4 called "row electrodes" intersected with a second array of electrodes called "column electrodes" X1 to X4. To each intersection of row and column electrodes there corresponds a cell C1 to C16. These cells are thus arranged in rows L1 to L4 and in columns CL1 to CL4.

Each row electrode Y1 to Y4 is connected to an output stage SY1 to SY4 of a row control device 1 and each column electrode X1 to X4 is connected to an output stage SX1 to SX4 of a column control device 2.

The working of these two control devices 1, 2 is controlled by an image management circuit 3.

For each cell, the voltage applied at a given time to a given cell C1 to C16 is the one resulting from the difference in potential, at this given instant, between the signals applied to the row electrode Y1 to Y4 and the column electrode X1 to X4 which define this cell.

Each output of the row control device 1 delivers voltage square-wave signals called "sustaining signals" SS on which addressing signals may be superimposed.

In a PP, each cell comprises a space occupied by a gas. By applying sufficient voltage between the two electrodes that define a given cell, there is prompted an electrical discharge in the gas and an emission of light by this cell.

In an alternating PP, the electrodes Y1 to Y4 and X1 to X4 are covered with a dielectric material and are therefore not in direct contact with the gas or with the discharge. Consequently, whenever there is a discharge in the gas, electrical charges collect in the dielectric at the two electrodes that define a cell in which a discharge occurs. These charges persist after the end of the discharge and enable the constitution of a "memory effect" for their presence at the level of a cell C1 to C16 enables the prompting of a discharge in this cell with the application of a voltage lower than that which will be necessary when these charges are absent.

The cells C1 to C16 which have such charges are said to be in the "recorded" or "lit" state. The other cells which require a higher voltage to produce a discharge are said to be in the "erased" or "extinguished" state. This effect is used by means of the sustaining signals SS to activate the cells C1 to C16 which are in the "recorded" state, namely to prompt discharges in these cells without modifying their state or modifying the state of the cells which are in the "erased" state.

The cells C1 to C16 are put into the "recorded" state or the "erased" state by means of addressing operations that are often performed row by row, namely for all the cells belonging to one and the same row L1 to L4 (in other words, for all the cells C1 to C16 defined by one and the same row electrode Y1 to Y4) and then for all the cells of another row.

FIG. 2 gives a simplified view, in the rows a, b, c, d, of the sustaining signals applied simultaneously to all the row electrodes Y1 to Y4 of a PP. It illustrates the addressing operations performed on these row electrodes: the rows a, b, c, d represent respectively the signals applied to the row electrodes Y1, Y2, Y3, Y4.

The sustaining signals are constituted by a succession of voltage square-wave signals set up on either side of a reference potential Vo which is often the ground potential. These square-waves vary between a negative potential V1 where they have a plateau or steady level and a positive potential V2 where they have another steady level. These positive and negative potentials V2, V1 with respect to Vo may each have for example a value of 150 volts. The reference potential Vo is applied to the column electrodes X1 to X4 in such a way that the application of the sustaining signals develops alternately positive and negative voltages of 150 volts, in the example, at the terminals of the cells. These voltages generate discharges in all the cells in the "recorded" state at each reversal of polarity, namely at each positive or negative transition tp, tn of the sustaining signals.

The sustaining signals have a period P which is currently in the range of 20 microseconds. This is a period during which the addressing of all the cells defined by a selected row electrode is done.

The addressing operations are managed by the image management device 3. They consist, for example, of the superimposition of the specific addressing signals on the square-waves that form the sustaining signals. Each row output stage SY1 to SY4 comprises, for example, to this effect a mixing circuit (not shown) by means of which it receives the sustaining signals and the addressing signals that come from different channels.

Assuming that the addressing operation performed on the row electrode Y1 starts at an instant to, the signal applied at this instant solely to this row electrode is an erasure pulse tne (shown in dashes) with a voltage lower than that of a square-wave, which prompts the placing of all the cells connected to this row electrode Y1 in the "erased" state. Then, at an instant t1 where the signal has its positive steady level, a so-called recording square-wave CI (shown in dashes) is superimposed (positively) on this stage. This recording square-wave has the effect of placing all the cells connected to this row electrode in the "recorded" state, except for those whose column electrodes X1 to X4 deliver a so-called "masking" signal (not shown) that has the effect of inhibiting the effects of the recording square-wave CI.

This operation may be repeated for each of the following periods, at the instants t2 and t3, t4 and t5, t6 and t7 where the addressing operations are thus performed on the row electrodes Y2, Y3 and Y4. During an image cycle period or frame period, these operations are performed at least once. In fact they are performed several times to obtain half-shades in the image. In view of the large number possible of row electrodes such as the electrodes Y1 to Y4, a number which may be far greater than one thousand, the time needed to perform the addressing may lead to the addressing of several rows during one and the same period P.

During the period when a row is addressed, the sustaining signals applied to the other row electrodes generate discharges in the cells in the "recorded" state. These discharges are in phase with the transitions tp, tn. These discharges constitute currents Id set up in the cells which are in phase with the transitions tp, tn as shown in the row e of FIG. 2.

The sustaining signals are applied synchronously to all the row electrodes Y1 to Y4. The result thereof is a simultaneity of the discharges which may lead to substantial drawing of current which could have a deleterious effect on the quality of the image.

Indeed, PP may have more than a thousand row electrodes and more than a thousand column electrodes, which define more than a million parallel-supplied cells. Thus, the total discharge current produced by all the cells in the "recorded" state may attain considerable values that are difficult to provide by the electronic means, all the more so as this current must be built up in a very short time so as not to hinder the physical phenomenon of the discharge in the gas of the cells.

The total discharge current, called the pulsed current, may vary very greatly from one instant to another as a function of the contents of the image. Consequently, the quantities of current drawn, to which there has to be a response from the voltage sources or amplifiers or generators used to prepare the signals and voltages applied to the row and column electrodes, vary greatly in themselves.

Given the non-zero source impedances of the voltage sources and amplifiers as well as the access impedances to the cells (related in particular to the inductors and resistors of the connections), the voltage actually applied to a given cell depends on the total content of the image as does the quantity of light produced by this cell.

This may result in a major deterioration in the quality of the image.

It may even result in a deterioration of certain elements such as, for example, power transistors used at output of the column output stages X1 to X4 which, owing to this fact, have to be greatly oversized despite the technical drawbacks (increase in the space requirement, capacitance, etc.).

The problems raised by the high value of the pulsed discharge current tend to acquire all the greater importance as, at the present time, there is a development of matrix screens and especially alternating color PPs towards large sizes.

In order to overcome the above-mentioned drawbacks, it has been proposed in the prior art to reduce the frequency of the sustaining signals. This leads to a reduction of the average discharge current but not to a reduction of the pulsed discharge current because, for all the rows, the discharges occur simultaneously. Furthermore, this approach leads to a reduction of the addressing speed.

One known approach consists of the multiplication or oversizing of all or part of the elements used to supply the cells with voltage. This approach has the drawback, inter alia, of being costly.

SUMMARY OF THE INVENTION

The present invention is aimed at reducing the pulsed current as referred to here above, arising from the simultaneous nature of the commands in the display screens, the cells of which, as in the case of plasma panels, have two stable states associated with a memory effect.

The method of the invention is a method for the control of a display screen having cells placed in a "recorded" state or in an "erased" state; the cells in the "recorded" state may be activated by sustaining signals to which the cells in the "erased" state are insensitive. The method consists in dividing the cells into at least two groups, then firstly in applying the sustaining signals to the different groups at time intervals that are staggered so that the sustaining signals are always applied to a single group and, secondly, in applying a memory signal to the cells when they do not receive the sustaining signals, this memory signal enabling them to preserve their "recorded" or "erased" state.

With the method of the invention, the maximum number of cells activated at each instant in a direction may be reduced to the point where the maximum pulsed current no longer constitutes an overload.

The electronic components that give the signals to the cells no longer need to be oversized.

This improvement is accompanied by a diminishing of the luminance of the screen. However, it is common to diminish the luminance to adjust it as a function of the ambient luminosity. In the prior art, this operation is often performed by reducing the frequency at which the sustaining cells are applied to the cells. However, this does not result in diminishing the pulsed current since, in this case, the simultaneous nature of the discharges is maintained.

It is therefore possible, with the method of the invention, to increase the luminance by increasing the frequency of the sustaining signals without increasing this pulsed current.

Another major advantage provided by the invention is that it can be used to reduce the capacitive consumption. The capacitive consumption is the consumption coming especially from the capacitors formed by the surfaces facing the row and column electrodes at their intersection. It must be noted that this consumption exists once the sustaining signals are applied to the cells, whether these cells are in the "recorded" state or in the "erased" state.

With the method of the invention, this consumption is reduced because the number of the cells receiving the sustaining signals is smaller than the total number of the cells.

BRIEF DESCRIPTION OF THE DRAWINGS

The invention will be understood more clearly from the following description of one of its embodiments, given by way of a non-restrictive example and illustrated by the appended figures, of which.

MORE DETAILED DESCRIPTION OF THE PREFERRED EMBODIMENTS

Figure 1:
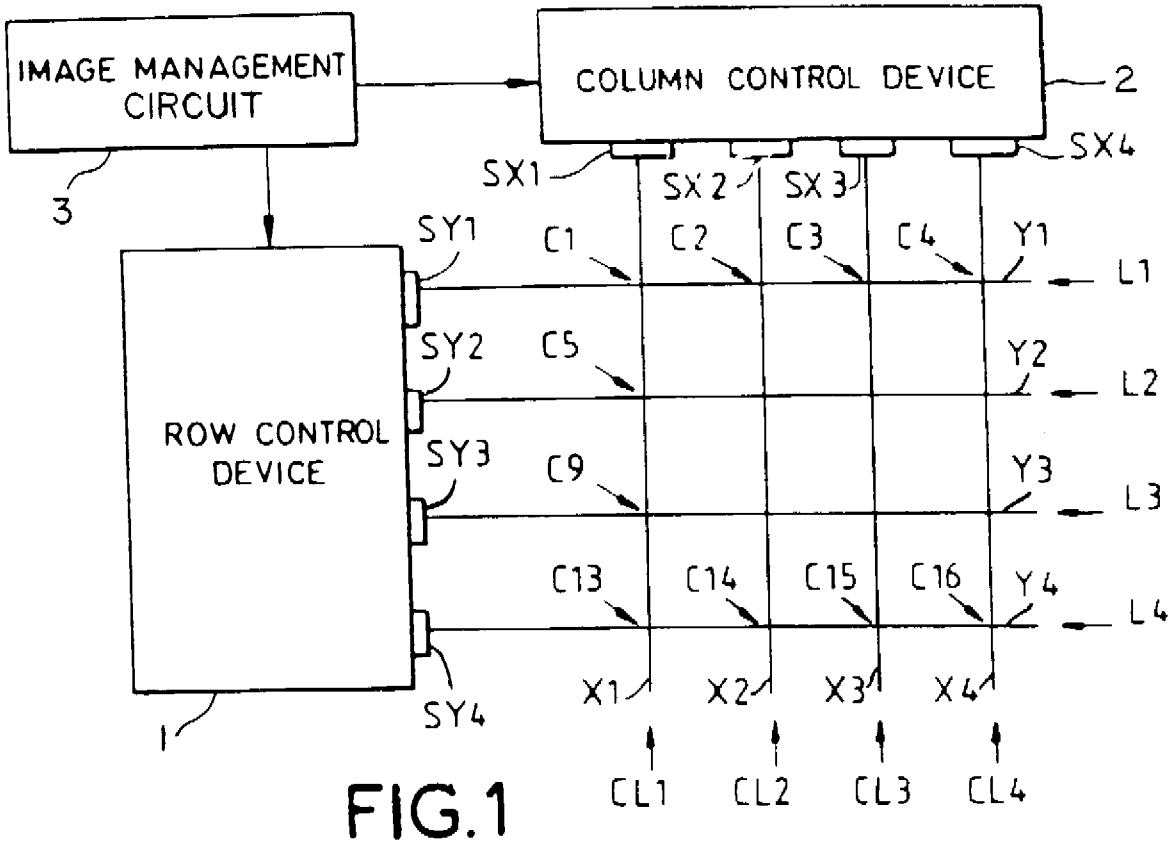
FIG. 1 is a schematic view of a prior art plasma panel.
Figure 3:
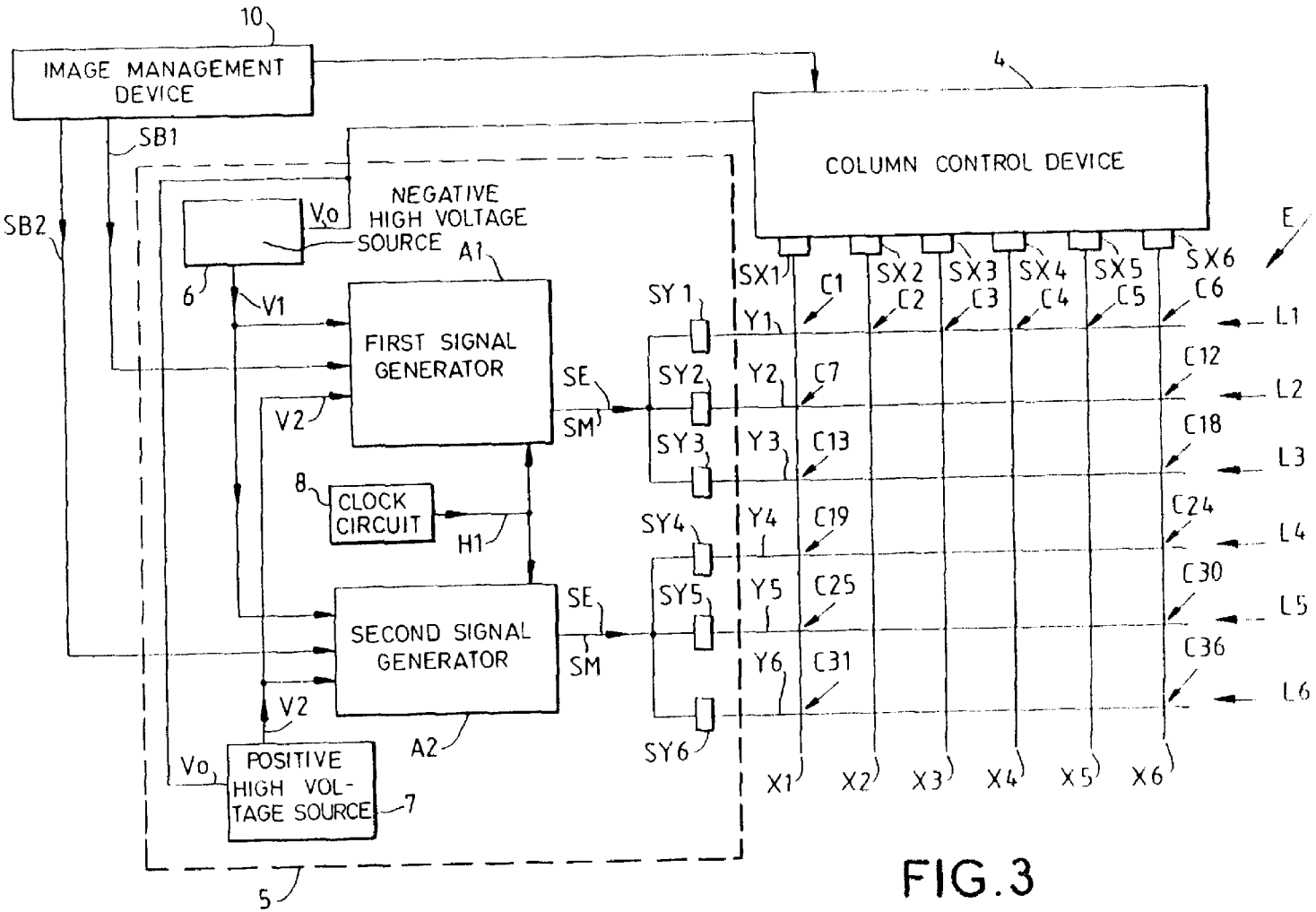
FIG. 3 gives a schematic view of a display device to which the method of the invention can be applied.

FIG. 3 shows a display device according to the invention. In the example of FIG. 3, the display device is an alternating plasma panel of a type similar to that of FIG. 1. Its screen E has an array of N row electrodes Y1 to Y6, an array of M column electrodes X1 to X6 (N and M being in the example equal to 6). The two arrays are orthogonal and each intersection of row and column electrodes defines a cell C1 to C36.

The column electrodes are each connected to a column output stage SX1 to SX6 of a column control device 4.

The row electrodes are each connected to a row output stage SY1 to SY6 to a row control device 5.

The working of the row and column control devices 5, 4 are controlled by an image management circuit 10.

Figure 2:
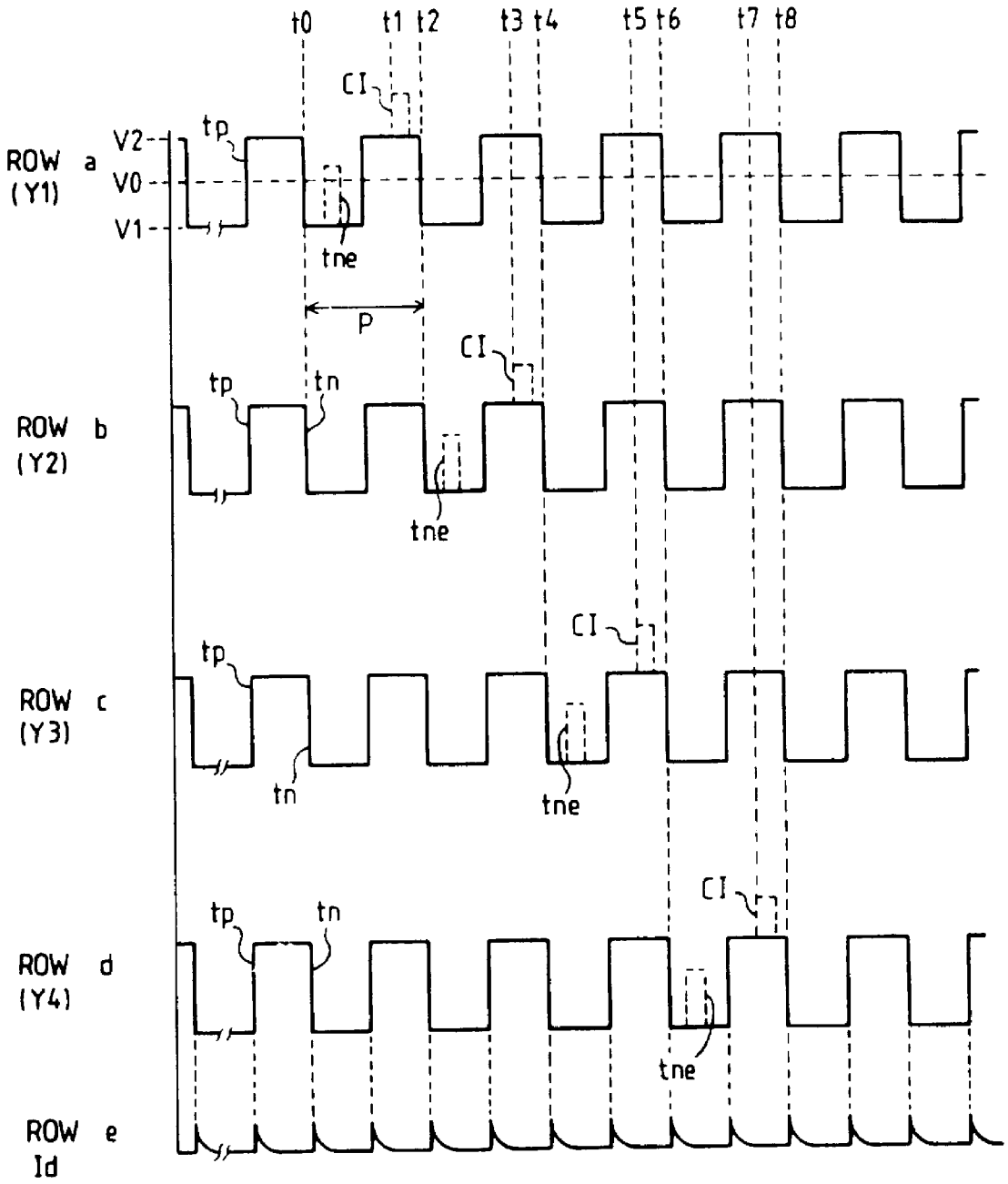
FIG. 2 already described shows the so-called "sustaining" signals applied to electrodes shown in FIG. 1.

The row control device 5 delivers sustaining signals SE, of the type already described with reference to FIG. 2, intended to activate the cells C1 to C36.

To this effect, it has at least two signal generators A1, A2, each capable of delivering sustaining signals SE to the row output stages SY1 to SY3, and SY4 to SY6 to which respectively they are connected.

The way in which such sustaining signals SS are prepared is in itself well known and the description given thereof hereinafter is given solely by way of a non-restricted example. In the example shown in FIG. 3, the row control device 5 has a negative high voltage source 6 and a positive high voltage source 7, respectively giving a negative potential V1 and a positive potential V2 equal to 150 V for example, as compared with a reference voltage Vo which is the ground potential. The potentials V1 and V2 are applied to two signal generators A1, A2 to enable each of them to prepare the sustaining signals SE by means of these potentials in a known manner, for example, by successive operations of commutation between these two potentials, at a frequency defined by a clock circuit 8. The clock circuit 8 is connected to the two generators A1, A2 to which it thus delivers clock signals H1, at a frequency that is the desired frequency for the sustaining signals.

With the method of the invention, the signal generators A1, A2 deliver the sustaining signals in turn.

Indeed, the method of the invention consists in not activating, i.e. in not applying the sustaining signals SS to all the cells C1 to C36 at a time.

To this end, in the non-restricted example shown in FIG. 3, the screen is divided into two parts and therefore the cells C1 to C36 are constituted into two groups C1 to C18 and C19 to C36 of which one is far more liable to be activated by sustaining signals SS while the other is not activated, and vice versa.

This is accomplished in the example of FIG. 3 by connecting the three row electrodes Y1 to Y3 from the upper part of the screen to the output stages SY1 to SY3 which depend on the first signal generator A1 and by connecting the three row electrodes Y4 to Y6 to the lower part of the screen, to the output stages SY4 to SY6 which depend on the second signal generator A2. A first high group is thus set up with the cells C1 to C18 and a second low group with the cells C19 to C36.

Naturally, another distribution could be made, and it is possible to have a number of groups of cells greater than two by increasing the number of signal generators such as A1, A2 and connecting them to the row electrodes according to the desired distribution which possibly may be unequal. In practice, the number N of row electrodes may be very great, 1280 for example. This may justify a larger number of groups of cells.

According to another characteristic of the invention, the cells that do not receive the sustaining signals SS receive a signal called a "memory signal" which has the function of preserving these cells in the "recorded" state or the "erased" state that was their state in the preceding sequence.

A distribution of the sustaining signals SE in an alternate manner between the first and second row voltage amplifiers A1, A2 may be controlled by the image management circuit 10. This circuit at all times has knowledge of the operations in progress during an image cycle period or frame period. It is a simple matter to make it command either of the signal generators A1, A2 at the appropriate instant. Thus, for example, in the example shown in FIG. 3, where the screen is separated into two parts having one and the same number of row electrodes Y1 to Y6, it is enough to assign half of the frame period to the delivery of the sustaining signals SE by the first signal generator A1 and the other half to the delivery of the sustaining signals SE for the second signal generator A2.

A control of the signal generators A1, A2 of this kind can be achieved in different ways, which are in themselves within the scope of those skilled in the art. It may consist for example in inhibiting their operation when they prepare the sustaining signals SE.

To this end, in the display device of the invention, the image management circuit 10 delivers a first signal called an "inhibition" signal SB1 to the first signal generator A1 and a second inhibition signal SB2 to the second signal generator A2.

Figure 5:
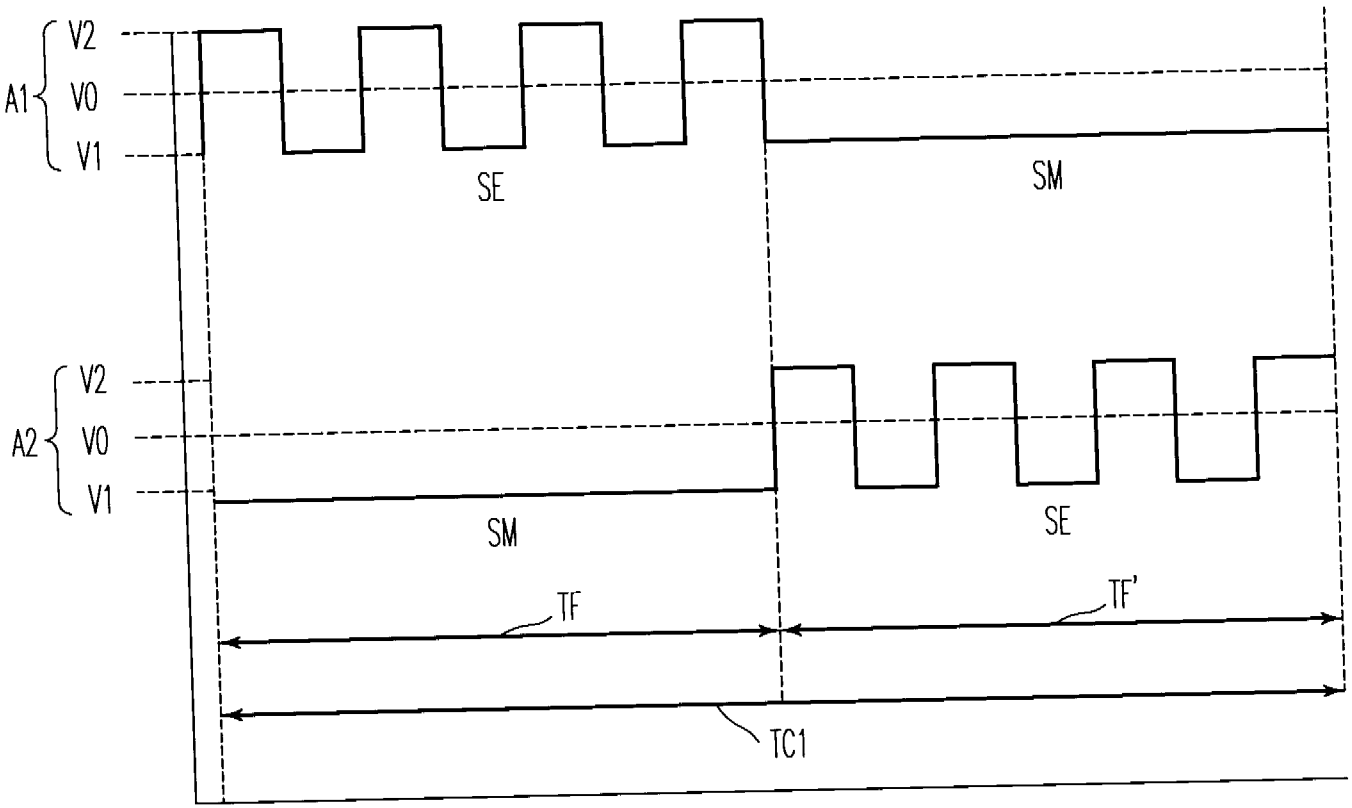
FIG. 5 is a graph of the voltage levels of the sustaining signals and memory signals in a single image cycle period generated by the first and second signal generators of the device shown in FIG. 3.

Furthermore, it must be noted that the inhibition of the operation of the voltage amplifiers A1, A2 can easily be achieved for example so that it takes place during a negative steady level having the first voltage value V1 or else a positive steady level having the second value V2, so that the signal generator A1 or A2 which is thus inhibited preserves this value V1 or V2 continuously until the time when it is again permitted, as shown in FIG. 5 deliver the sustaining signals SE.

The DC voltage with a value V1 or V2 which subsequently is applied to the row electrodes Y1 to Y3 or Y4 to Y6 has the effect of not modifying the electrical charges that might have been collected by the corresponding cells C1 to C36. These cells thus preserve their "memory", namely the "recorded" state or the "erased" state which was their state before this DC voltage called the "memory signal" SM replaces the sustaining signals SE.

Thus, when the management circuit 10 dictates the inhibition of the second amplifier A2, the first inhibition command SB1 is inoperative and the first amplifier A1 delivers the sustaining signals SE while the second amplifier A2 delivers the memory signal SM. Then, when the time allocated to the first amplifier A1 has elapsed, i.e. in the example when the time allocated to the image display by the upper part of the screen has elapsed, the first inhibition command SB1 becomes operative and the second inhibition command stops being operative: consequently, the second generator A2 delivers the sustaining signals SS and the first generator A1 delivers a memory signal SM and vice versa.

The time allocated to the image display by each part of the screen, namely the time allocated to the operation of each generator A1, A2, is related to the number of rows and hence of row electrodes Y1 to Y6 controlled by each generator A1, A2.

The operating time TF of a signal generator such as A1, A2 corresponds to $TF=TCI\times{}^{nL}/_{N}$, where TCI is the total image cycle period, nL the number of row electrodes controlled by the generator, and N the total number of the row electrodes of the screen.

Figure 4:
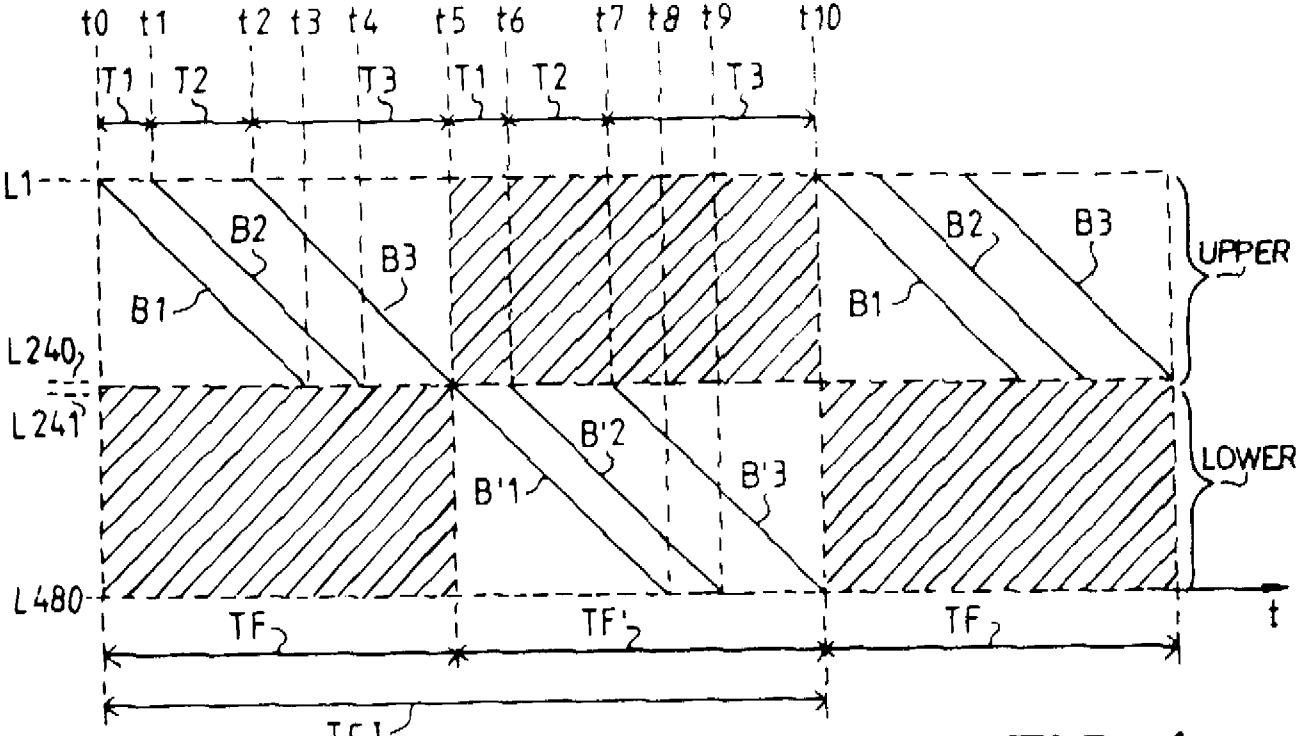
FIG. 4 illustrates the working of a screen controlled according to the method of the invention.

FIG. 4 illustrates the way in which the image display is done on two zones by a screen controlled according to the method of the invention.

FIG. 4 shows the commonly encountered case of a PP screen having 480 rows of cells (formed by means of as many row electrodes) and for example 1920 columns of cells. These row electrodes are connected to a first and second generator of sustaining signals such as the generators A1, A2 so that the 240 rows of cells 1 to 240 of the upper part of the screen form a first upper group of cells controlled by the first generator A1 and so that the rows of cells 241 to 480 of the lower part of the screen forms a second lower group of cells.

Assuming that the beginning of the time of operation of the first generator A1 is at the instant to, this generator delivers sustaining signals SE that are applied simultaneously to the 240 row electrodes at the upper part of the screen while the 240 row electrodes of the lower part of the screen (electrodes Nos. 241 to 480) receive only a memory signal SM delivered by the second generator A2. This situation lasts for a period of time TF that is half the total image cycle period TCI or frame period. This situation is illustrated in FIG. 4 by the fact that the space facing the rows Nos. 1 to 240 is blank and the space facing the rows Nos. 241 to 480 is hatched with oblique lines.

Hence, starting from the instant to, the cells of the rows of the upper part of the screen are liable to give light while the cells of the rows of the lower part of the screen remain extinguished. At the instant to, there also starts a first sub-scanning operation B1, namely a first addressing sequence to address the rows of this part of the screen. This addressing is done row by row and it is aimed at placing the cells that form these rows in the "recorded" or "erased" state depending on the image to be displayed, and on the half-shades desired.

At the instant t1, there starts a second sub-scanning operation B2 that occurs at the end of a time interval T1 after the first sub-scanning B1.

At the instant t2, there starts a third sub-scanning B3 of the upper part of the screen that occurs at the end of a period of time T2 equal to twice T1.

The instants t3 and t4 that follow respectively mark the end of the first scanning and the second scanning B1, B2.

The instant t5 marks the following together:

a) the end of the third sub-scanning B3, b) the end of the sustaining period of the upper part of the screen, namely the period of display by the rows 1 to 240, the cells of which are no longer activated, namely the end of the period of time during which the first generator A1 delivers the sustaining signals, c) the start of the period of time during which the second generator A2 delivers the sustaining signals, and when the cells formed with the rows 241 to 480 of the lower part of the screen are liable to be activated and to give light, d) the beginning of a first sub-scanning operation B'1 of this low part of the screen.

The instant t5 is separated from the instant t2 by a period of time T3 equal to twice T2. It must be noted that the different time intervals between the sub-scanning operations can be used to obtain a number of half-shades varying by a power of 2 with the number of sub-scanning operations.

At the instant t6, there starts a second sub-scanning operation B'2 of this low part of the screen. The instants t5 and t6 are separated by a time T1.

At the instant t7, there starts a third sub-scanning operation B'3 of this part of the screen; the instant t7 follows the instant t6 after a period of time T2.

The instants t8 and t9 respectively mark the end of the first and second operations B'1 and B'2 for the sub-scanning of this low part of the screen.

The instant t10 represents the end of a frame period TCI and the end of the third sub-scanning operation B'3. It also represents the end of the period of activation of the rows 241 to 480, namely the low part of the screen. With the end of the operation of the second amplifier A2, the instant t10 also marks the return of the operation of the first amplifier A1 and the display by the upper part of the screen for a new period TF, during which the operations occurring between the instant to and t5 are repeated.

It must be noted that shortly after the instant t5, when the lower rows of the screen are activated, for the lowest rows that have not yet been involved in the addressing sequence with sub-scanning B'1, the state of the cell is the one given to them by their previous addressing and preserved by them between the instant to and the instant t5, through the application of the above-mentioned memory signal SM.

The exemplary operation illustrated in FIG. 4 can be applied for example to the case of a plasma panel having 480 rows, the sustaining of which is done at 50 kHz. This, taking account of the fact that the operation is done by half-screen, gives a luminance equivalent to a sustaining frequency of 25 kHz. By using a dual addressing technique, 10 $\mu$s per row are required and with three sub-scanning operations that permit eight half-shades of gray, the frame frequency is in the range of 70 Hz.

What is claimed as new and desired to be secured by Letters Patent of the United States is:

1. A method for the control of a display screen comprising the steps of:

placing a plurality of cells in a recorded state or in an erased state;

enabling cells in the recorded state to be activated by sustaining signals;

preventing cells in the erased state from being activated by the sustaining signals;

dividing the plurality of cells into at least two groups;

applying the sustaining signals to the at least two groups of cells at different times such that only one of said at least two groups receives the sustaining signals at any given time; and applying memory signals to cells not receiving the sustaining signals, said memory signals causing said cells not receiving the sustaining signals to maintain a recorded state or an erased state.

2. The method of claim 1, wherein the step of applying the sustaining signals comprises the step of:

providing the sustaining signals with an alternating voltage such that the sustaining signals have a minimum voltage and a maximum voltage; and wherein the step of applying the memory signals further comprises the step of:

providing the memory signals with a constant voltage equal to either the minimum voltage or the maximum voltage of the sustaining signals.

3. The method of claim 1, further comprising the step of:

providing a plurality of row electrodes and a plurality of column electrodes intersecting the row electrodes, each intersection of a row electrode and a column electrode defining one of said plurality of cells;

wherein the step of applying the sustaining signals comprises the step of:

applying the sustaining signals to the row electrodes corresponding to the only one of said at least two groups of cells receiving the sustaining signals.

4. The method of claim 1, further comprising the step of:

providing a signal generator for each of said at least two groups of cells; and generating the sustaining signals with one of said signal generators.

5. The method of claim 4 further comprising the step of:

controlling the signal generators such that sustaining signals are generated only by the signal generator associated with the only one of said at least two groups of cells receiving the sustaining signals at any given time.

6. The method of claim 5, further comprising the step of:

generating the memory signals with the signal generators which are not generating the sustaining signals.

7. The method of claim 1, further comprising the step of:

activating each of said at least two groups of cells once during an image cycle.

8. An image display device comprising:

a plurality of row electrodes and a plurality of column electrodes intersecting the row electrodes such that each intersection of a row electrode and a column electrode defines one of a plurality of cells divided into a plurality of groups of cells, each cell being in a recorded state or an erased state; and a row control device configured to deliver sustaining signals to only one of said plurality of groups of cells at any given time and to deliver memory signals to the other groups not receiving the sustaining signals such that the state of the cells receiving the memory signals does not change;

wherein cells which receive the sustaining signals while in the recorded state are susceptible to activation by the sustaining signals and cells which receive sustaining signals while in the erased state are not susceptible to activation by the sustaining signals.

9. The image display device of claim 8, wherein the row control device comprises:

a plurality of signal generators, each associated with a single group of cells.

10. The image display device of claim 9, wherein each of said signal generators comprises:

means for alternating the sustaining signals between a maximum voltage and a minimum voltage; and means for generating the memory signals such that the memory signals have a constant voltage equal to either the maximum voltage or the minimum voltage of the sustaining signals.

11. The image display device of claim 8, further comprising:

an image management device configured to control the application of the sustaining signals and memory signals applied to the row electrodes by the row control device.

12. The image display device of claim 8, wherein:

said plurality of cells form a plasma panel screen.

* * * * *